US007644709B2

(12) United States Patent
Tilby et al.

(10) Patent No.: US 7,644,709 B2
(45) Date of Patent: Jan. 12, 2010

(54) WRIST STRAP FOR BOW STRING RELEASE ASSEMBLY

(76) Inventors: Daniel M. Tilby, 9352 S. 670 West, Sandy, UT (US) 84070; John Tilby, 9352 S. 670 West, Sandy, UT (US) 84070

( * ) Notice: Subject to any disclaimer, the term of this patent is extended or adjusted under 35 U.S.C. 154(b) by 337 days.

(21) Appl. No.: 11/653,456

(22) Filed: Jan. 16, 2007

(65) Prior Publication Data

US 2008/0168970 A1 Jul. 17, 2008

(51) Int. Cl.
*F41B 5/18* (2006.01)

(52) U.S. Cl. ..... 124/35.2

(58) Field of Classification Search ..... 124/35.2; 2/16, 20, 161.5; 224/164, 178, 183, 267
See application file for complete search history.

(56) References Cited

U.S. PATENT DOCUMENTS 2,615,227 A * 10/1952 Hornik ..... 24/303
4,426,989 A * 1/1984 Sutton ..... 124/35.2
4,831,997 A * 5/1989 Greene ..... 124/35.2
5,197,168 A * 3/1993 Levy ..... 24/303
5,317,789 A * 6/1994 Levy ..... 24/303
6,125,833 A * 10/2000 Tentler et al. ..... 124/35.2
2003/0229974 A1 * 12/2003 Zemer et al. ..... 24/303

* cited by examiner

*Primary Examiner*—John Ricci

(57) ABSTRACT

A wrist strap for use with a bow string release assembly, including a pair of interconnected fabric limbs extending angularly from a common central area and a fabric covered magnet in the free end of each limb; the magnets being arranged to attract one another when the free end of one limb is placed proximate the free end of the other limb; and a connector strap with a connector member thereon fixed to the first limb and another connector strap with a cooperating second connector member thereon, the connector members being releasably locked together to affix the wrist strap to the wrist of a user; and a tether strap fixed to the common area, and including means to attach the tether to a bow trigger assembly.

4 Claims, 3 Drawing Sheets

WRIST STRAP FOR BOW STRING RELEASE ASSEMBLY

CROSS-REFERENCE TO RELATED APPLICATIONS

Figure 1:
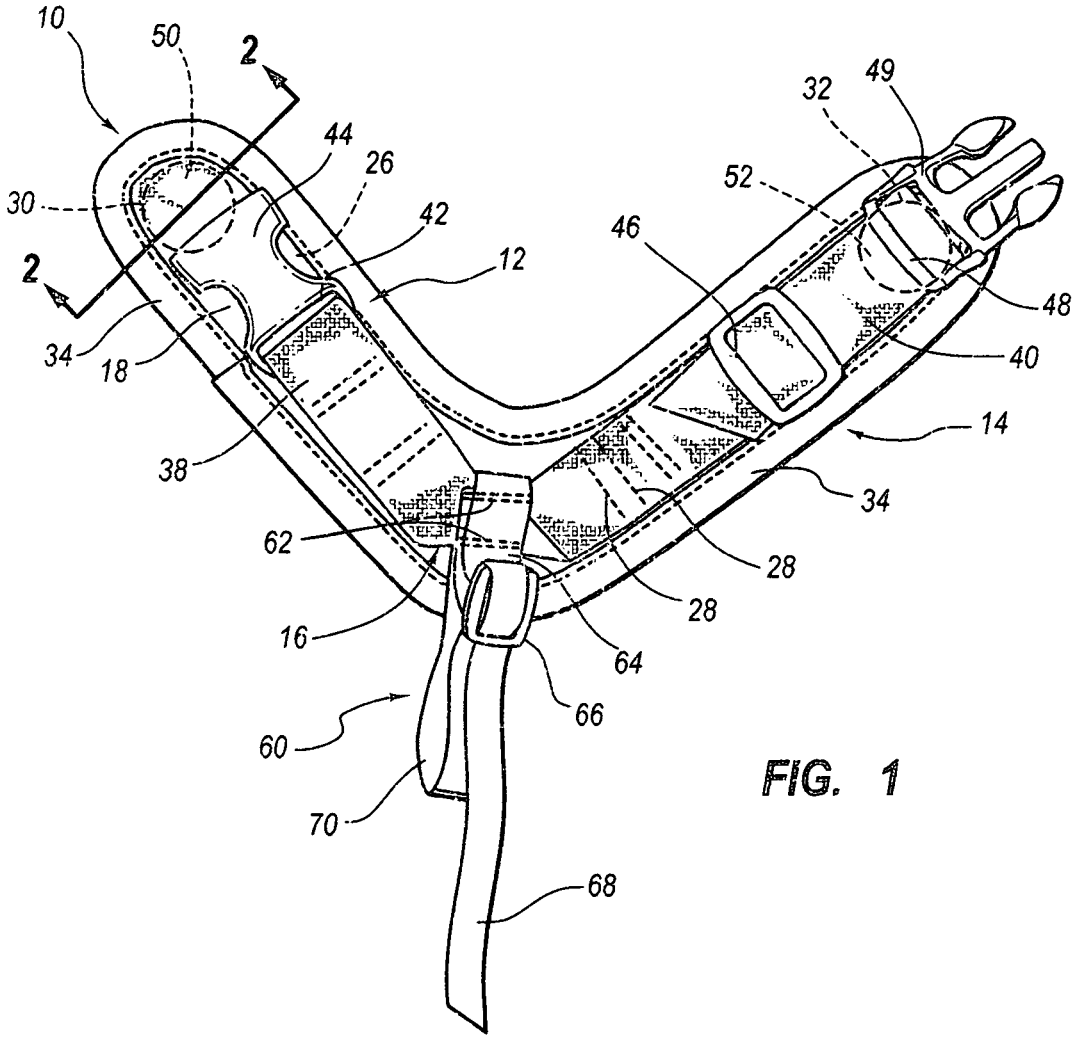

Not Applicable.

STATEMENT REGARDING FEDERALLY SPONSORED RESEARCH OR DEVELOPMENT

Not Applicable.

REFERENCE TO MICROFICHE APPENDIX

Not Applicable.

BACKGROUND OF THE INVENTION

Field of the Invention

This invention relates to wrist straps that are commonly used by archers to secure a bow string release assembly.

It has long been recognized that various devices can be used for attachment to a bow string and to hold the bow string as it is pulled to be ready for release by an archer. Such devices frequently include jaws to clamp onto a bow string and a trigger assembly with a trigger that can be pulled to release the jaws and drawn string in order to hunch an arrow from a bow. It is well known that such release devices are often attached by a tether to a wrist strap secured to the wrist of a user. A tether and wrist strap serve to prevent dropping of the trigger assembly and holds the trigger assembly suspended from the user's wrist and conveniently available for repeated use.

In attaching the wrist strap to the wrist of a user, it is generally common to have opposite ends of the strap passed around the user's wrist and then buckled in place. A flexible tether line generally interconnects the wrist strap and the trigger assembly such that the trigger assembly can be grasped by the fingers of a user and can be pulled with an attached bow string to a drawn position. Thereafter, pulling the trigger of the trigger assembly releases the bow string to propel an arrow from a bow.

It has long been common to attach the trigger assembly that is used to pull the string of a bow, through a tether, to a wrist strap that is then buckled, or otherwise locked to the wrist of the user of the bow.

When the wrist strap attached by a tether to the trigger mechanism is secured to the wrist of a bow hunter in the field, it has been found that even the slightest sounds created during securing or releasing of the wrist strap will alert game being hunted by the user.

It has also been found that it is difficult and time consuming to secure a strap to the wrist of a user, since the user is generally only able to use one hand while putting the strap on the wrist attached to his other hand. To better facilitate positioning of the strap on the wrist, various types of easily affixed strap holding means have been proposed. For example, buckles of various types have been proposed to attach the ends of a strap around a wrist. The buckles are difficult to manipulate with one hand. Animals being targeted may move out of range while the buckles are fastened. More recently hook and loop fasteners such as "Velcro" fasteners, have been used. The hook and loop fasteners frequently are more easily fastened with one hand. However, even the more easily interlocked hook and loop fasteners will often make noise, even a slight noise, when the hook and loop members are secured together and/or separated. The noise made, even if very slight, will frequently alert game to the presence of a hunter preparing to shoot a bow.

There remains a need for a wrist strap fastener assembly that will easily attach to one end of a trigger assembly and that has strap ends to be initially secured, using one hand, around a bow shooter's wrist easily, quickly, and silently. Once the strap has been initially secured, it is much easier again using the one available hand to more positively secure the strap to the wrist of a user.

BRIEF SUMMARY OF THE INVENTION

Objects of the Invention

Principal objects of the present invention are to provide a wrist strap that will easily attach to variety of trigger mechanisms that are commonly used for pulling, holding, and releasing a bow string of a bow used in the hunting of animals. The wrist strap must be attached and released from the user's wrist, without making noise that will alert game being hunted.

Another object of the invention is to provide a wrist strap that can be easily affixed to one wrist of a user, using only the hand and fingers attached to the other wrist of the user.

Features of the Invention

Principal features of the invention include a wrist strap with a tether that will attach to a trigger assembly for drawing and releasing the string of a bow, the strap being initially held in place by magnets affixed to the opposite ends of the strap and then positively locked in place by buckle structure, or other fastener attached to the ends of the strap.

Additional objects and features of the invention will become apparent to persons skilled in the art to which the invention pertains from the following detailed description and claims.

BRIEF DESCRIPTION OF THE FIGURES OF THE INVENTION

In the Drawings

Figure 2:
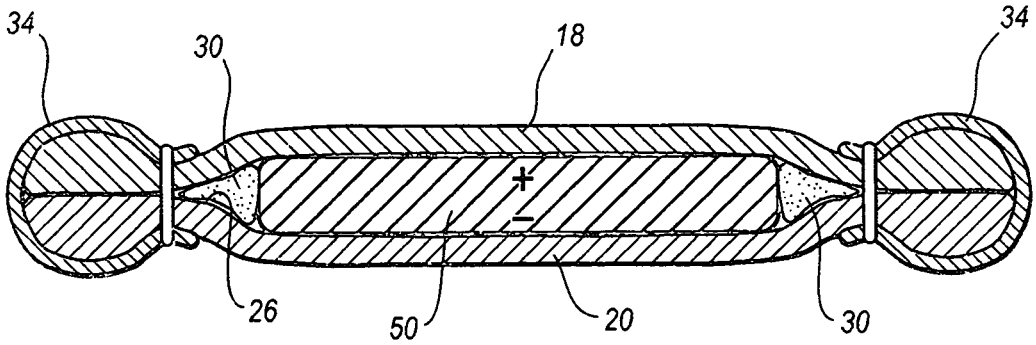
Figure 3:
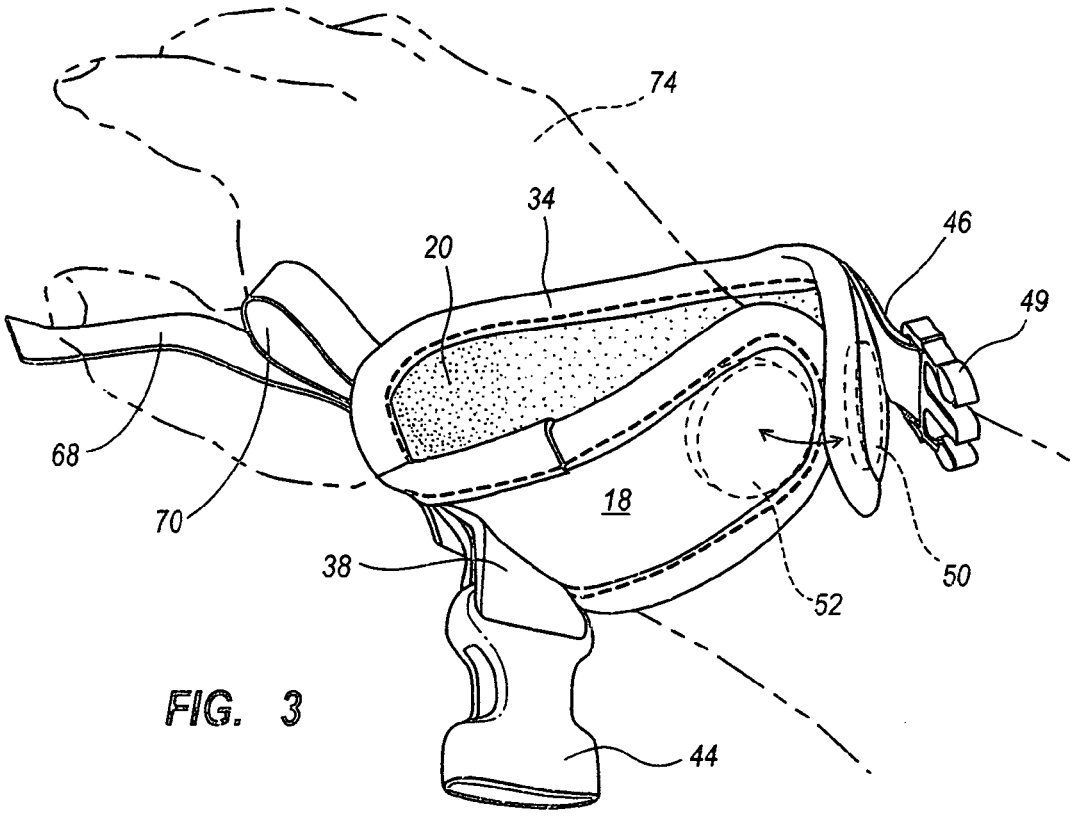
Figure 4:
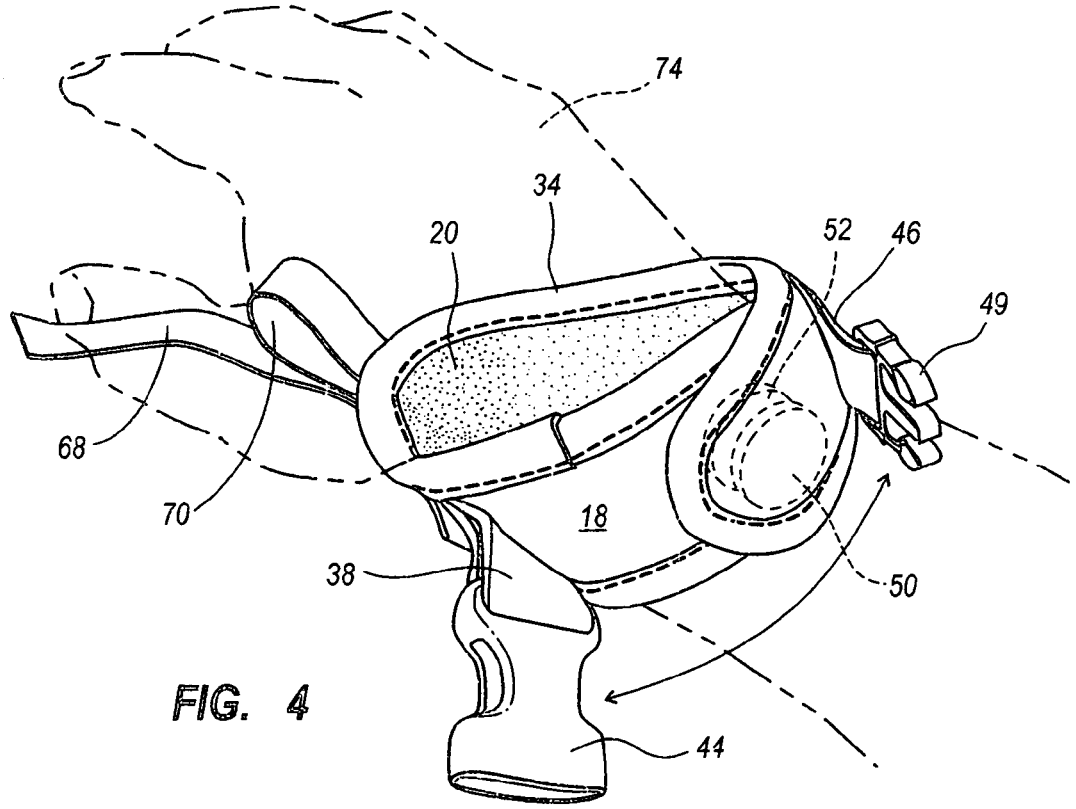
Figure 5:
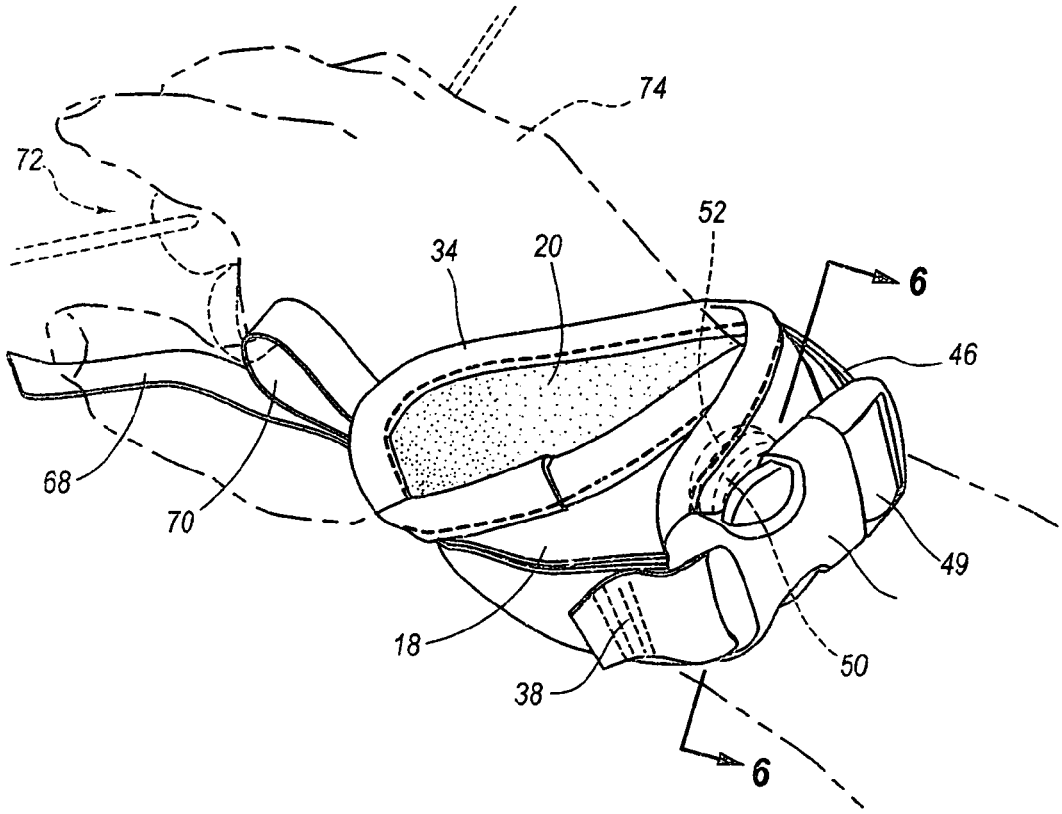
Figure 6:
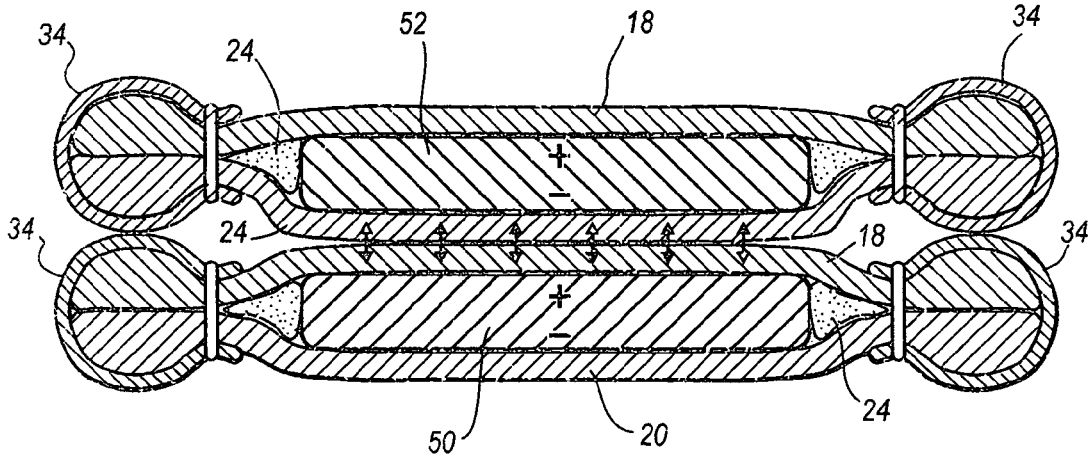

FIG. 1 is a top plan view of the strap of the invention;

FIG. 2, a vertical section taken on the line 2-2 of FIG. 1;

FIG. 3, a perspective view of the strap of the invention shown in the process of being attached to the wrist (shown in phantom) of a user;

FIG. 4, a view like that of FIG. 3, but showing the strap initially secured to the wrist of the user;

FIG. 5, a view like that of FIG. 4, but showing the strap securely affixed to the wrist of the user; and FIG. 6, an enlarged sectional view, taken on the line 6-6 of FIG. 4.

DETAILED DESCRIPTION

Referring now the Drawings:

In the illustrated preferred embodiment of the invention, the wrist strap, shown generally at 10, is generally V-shaped, with limbs 12 and 14 joined at a common central area 16 and projecting from the common area.

The limbs 12 and 14 are formed from a top layer 18 of fabric and a bottom layer 20 of the fabric.

Padding 26 is provided between the top layer of fabric 18 and bottom layer 20, and is sewn in place between the layers with seams 28. The padding simply makes the wrist strap more comfortable when the strap is secured to the wrist of a user.

Pockets 30 and 32 are respectfully formed in the free ends of limbs 12 and 14, i.e., the ends of limbs 12 and 14 remote from the common central area 16 from which the limbs extend.

An edge binding 34 extends fully around the outer edge of the limbs 12 and 14, and is sewn thereon to hold the fabric layers 18 and 20 and the padding 24 together.

Buckle straps 38 and 40 are also respectively sewn to the top fabric 18 and extend outwardly on the limb 12 and 14 from the central area 16. The buckle strap 38 is passed through a slot 42 in a female buckle receptacle 44 and is then sewn to the limb 12.

The buckle strap 40 passes through a length adjuster 46 and through a slot 48 of a male buckle insert 49 before being turned back and through the length adjuster 46.

A magnet 50 is positioned in the pocket 30 and a magnet 52 is positioned in the pocket 32. The magnets are positioned such that they will attract one another when the free end of one limb is positioned over (or adjacent to) the free end of the other limb.

A connector strap 60 is sewn intermediate its length at 62 to the central area 16 of wrist strap 10. One end 64 of strap 60 has a length adjuster 66 connected thereto. The other end 68 of connector strap 60 is passed through length adjuster 66 to the extent necessary to provide a loop 70 of desired length. Loop 70 will secure a bow trigger assembly 72, shown in phantom in FIG. 1, to fit in a palm of a hand 74, also shown in phantom, for use in drawing and releasing a bow string (not shown).

In use, the wrist strap 10 is attached to a bow trigger assembly, such as shown fragmentarily at 72. A user then places the common central area in the palm of his hand to be used to draw a bow string. A first limb 12 or 14 is positioned to extend past the heel of the palm and to place either the pocket 32 and magnet 52, or the pocket 30 and magnet 50 on top of the wrist of the user. Thereafter, the second limb 12 or 14 is positioned to place the other pocket 32 and magnet 52, or pocket 30 and magnet 50 on top of the first positioned limb, pocket and magnet. Since the magnets 50 and 52 are both covered with fabric, i.e., fabric layers 18 and 20, the magnets will attract and hold the limbs together without having a metal to metal contact that will make noise. Properly arranged, fabric covered magnets could alternatively be placed adjacent one another, for example, side-by-side rather than on top of one another.

The attracting magnets are easily positioned on a user's wrist using only his other hand.

With the ends of the limbs initially held in place by the magnets, and not falling off the wrist, even though not as secure as desired during use of the wrist strap, the user can then, with one free hand, securely fasten the buckle or other securement device. This provides a more positive attachment of the wrist strap to the wrist of the user.

Although a preferred embodiment of our invention has been herein described, it is to be understood that the present disclosure is by way of example and that variations are possible without departing from the subject matter coming within the scope of the following claims, which subject matter we regard as our invention.

We claim:

1. A wrist strap for a bow string release assembly comprising a pair of limbs extending angularly apart from a common central area, each said limb and said common area being formed from a top layer of fabric and a bottom layer of fabric;

a pocket formed in each limb at the end remote from the common area and between said top layer and said bottom layer of fabric;

a magnet fixed in the pocket of each limb, said magnets being arranged to attract one another when the end of one limb remote from the common area is positioned proximate the end of the other limb remote from the common area; and a buckle strap fixed to said top layer of fabric of each limb with one buckle connector member being secured to one buckle strap and a cooperating buckle connector member being secured to the other buckle strap, whereby connection of said buckle connector members locks said buckle straps together.

2. A wrist strap for a bow string release assembly as in claim 1, wherein said magnets are arranged to attract one another when the end of one limb remote from the common area is positioned over the end of the other limb remote from the common area.

3. A wrist strap as m claim 2, further including a tether having one end fixed to the central area; and means on the tether for securement to a bow trigger assembly.

4. A wrist strap as in claim 3, further including padding between the top layer of fabric and the bottom layer of fabric and around the pocket in each limb.

* * * * *